US010224659B2

(12) United States Patent
Pemwieser et al.

(10) Patent No.: US 10,224,659 B2
(45) Date of Patent: Mar. 5, 2019

(54) CONTACT SLEEVE FOR AN ELECTRIC PLUG CONNECTOR

(71) Applicant: Rosenberger Hochfrequenztechnik GmbH & Co. KG, Fridolfing (DE)

(72) Inventors: Manuel Pemwieser, Burghausen (DE); Martin Zebhauser, Laufen (DE); Christian Anfang, Bergen (DE)

(73) Assignee: ROSENBERGER HOCHFREQUENZTECHNIK GMBH & Co. KG, Fridolfing (DE)

( * ) Notice: Subject to any disclaimer, the term of this patent is extended or adjusted under 35 U.S.C. 154(b) by 0 days.

(21) Appl. No.: 16/060,494

(22) PCT Filed: Feb. 26, 2016

(86) PCT No.: PCT/EP2016/000336
§ 371 (c)(1),
(2) Date: Jun. 8, 2018

(87) PCT Pub. No.: WO2017/144069
PCT Pub. Date: Aug. 31, 2017

(65) Prior Publication Data
US 2018/0366856 A1 Dec. 20, 2018

(51) Int. Cl.
*H01R 13/187* (2006.01)
*H01R 13/05* (2006.01)
(Continued)

(52) U.S. Cl.
CPC ..... *H01R 13/187* (2013.01); *H01R 4/48* (2013.01); *H01R 13/052* (2013.01);
(Continued)

(58) Field of Classification Search
CPC .. H01R 13/6596; H01R 13/512; H01R 24/28; H01R 13/5841; H01R 13/508;
(Continued)

(56) References Cited

U.S. PATENT DOCUMENTS 4,550,972 A 11/1985 Romak
4,662,706 A * 5/1987 Foley ..... H01R 13/187 439/843
(Continued)

FOREIGN PATENT DOCUMENTS

DE 202015006807 U1 10/2015
EP 0858133 A2 8/1998

*Primary Examiner* — Jean F Duverne
(74) *Attorney, Agent, or Firm* — David P. Dickerson

(57) ABSTRACT

The invention relates to a contact sleeve (10) in the form of a hollow cylinder having a casing wall (12) and a center longitudinal axis (14) for an electrical connector for establishing electrical contact with a mating connector (32), wherein the contact sleeve (10) has at least two pairs of contact spring lamellae (18) on its casing wall (12), wherein the contact spring lamellae (18) of a pair are arranged radially opposite one another on the contact sleeve (10), wherein each contact spring lamella (18) has a radial raised portion (20) which forms an electrical contact area (22), wherein the raised portions (20) of a pair of contact spring lamellae (18) which are situated opposite one another are arranged at the same location in the axial direction with respect to the contact sleeve (10) in such a way that the contact areas (22) of said contact spring lamellae lie on a straight line (24) which perpendicularly intersects the center longitudinal axis (14) of the contact sleeve (10). In this case, the raised portions (20) of at least one first pair of contact spring lamellae (18) are arranged in a manner offset by a predetermined axial offset length (26) in the axial direction with respect to the contact sleeve (10) relative to the raised portions (20) of at least one second pair of contact spring lamellae (18).

7 Claims, 2 Drawing Sheets

(51) Int. Cl.

| | |
|---|---|
| ***H01R 13/11*** | (2006.01) |
| ***H01R 13/17*** | (2006.01) |
| ***H01R 13/24*** | (2006.01) |
| ***H01R 24/40*** | (2011.01) |
| ***H01R 4/48*** | (2006.01) |

(52) U.S. Cl.
CPC ..... *H01R 13/111* (2013.01); *H01R 13/17* (2013.01); *H01R 13/2492* (2013.01); *H01R 24/40* (2013.01)

(58) Field of Classification Search
CPC ..... H01R 13/74; H01R 13/187; H01R 13/26; H01R 13/113; H01R 13/6592; H01R 13/6589; H01R 13/434; H01R 13/6463; H01R 13/623
USPC ..... 439/843
See application file for complete search history.

(56) References Cited

U.S. PATENT DOCUMENTS 5,431,576 A * 7/1995 Matthews ..... H01R 13/113 439/247
5,556,292 A 9/1996 Kato et al.
5,667,413 A 9/1997 Trafton
5,676,571 A * 10/1997 Matthews ..... H01R 13/187 439/839
6,299,492 B1 * 10/2001 Pierini ..... H01R 13/26 439/884
8,821,170 B1 9/2014 Thein et al.

* cited by examiner

CONTACT SLEEVE FOR AN ELECTRIC PLUG CONNECTOR

The invention relates to a contact sleeve in the form of a hollow cylinder having a casing surface and a center longitudinal axis for an electrical connector for establishing electrical contact with a mating connector, wherein the contact sleeve has at least two pairs of contact spring lamellae on its casing surface, wherein each pair of contact spring lamellae are arranged radially opposite one another on the contact sleeve, wherein each contact spring lamella has a radial raised portion which forms an electrical contact area, wherein the raised portions of a pair of contact spring lamellae which are situated opposite one another are arranged at the same location in the axial direction with respect to the contact sleeve in such a way that the contact areas of said contact spring lamellae lie on a straight line which perpendicularly intersects the center longitudinal axis of the contact sleeve, as claimed in the preamble of patent claim 1.

Connectors, in particular coaxial connectors, serve to releasably connect coaxial cables. Coaxial connectors are of coaxial design like coaxial cables, and they therefore have the advantages of coaxial cables, specifically low electromagnetic influencing and irradiation and also good electrical shielding and also an impedance which corresponds to that of the connected coaxial cable in order to avoid reflection phenomena at the transition point between the coaxial connector and the coaxial cable. In this case, a coaxial cable, also called coax cable for short, is understood to mean a 2-pole cable of concentric design which has an internal conductor (also called core) which is surrounded by a hollow-cylindrical external conductor at a constant distance. The external conductor shields the internal conductor against electromagnetic interference radiation. An insulator or dielectric is arranged in the intermediate space between the internal conductor and the external conductor.

Coaxial connectors are designed to provide a predetermined characteristic impedance, for example of 50Ω, in order to ensure reflection-free transmission of RF signals. The characteristic impedance of a coaxial connector depends, amongst other things, on the ratio of the inside diameter of the external conductor and the diameter of the internal conductor. Therefore, electrical connection of a coaxial cable to a coaxial connector requires coaxial connectors which are matched to the respective inside diameter and outside diameter of the coaxial cable.

The invention is based on the object of improving a contact sleeve in respect of manual handling during connection to a mating connector.

According to the invention, this object is achieved by a contact sleeve of the abovementioned type having the features identified in claim 1. Advantageous refinements of the invention are described in the further claims.

To this end, the invention provides, in the case of a contact sleeve of the abovementioned kind, that the raised portions of at least one first pair of contact spring lamellae are arranged in a manner offset by a predetermined axial offset length in the axial direction with respect to the contact sleeve relative to the raised portions of at least one second pair of contact spring lamellae.

This has the advantage that, when the contact sleeve is inserted into a mating plug in the axial direction, the raised portions make mechanical and electrical contact with the mating plug only one after the other, so that plugging forces are reduced.

For the purpose of making corresponding electrical and mechanical contact with the mating plug radially on the inside or outside with respect to the contact sleeve, the raised portions rise radially inward and/or outward beyond the contact sleeve or beyond the casing wall.

A particularly good reduction in the plugging forces when there are a large number of electrical contact areas at the same time is achieved in that three pairs of contact spring lamellae with respective raised portions are formed on the contact sleeve, wherein the raised portions of each pair is arranged in an offset manner in the axial direction relative to the raised portions of all of the other pairs.

A contact sleeve which is particularly simple to produce is achieved in that the contact spring lamellae are formed by recesses in the contact sleeve or the casing wall of the contact sleeve which are arranged at a distance from one another in the circumferential direction.

Contact spring lamellae which are particularly stable and mechanically resistant and at the same time have high spring forces for good electrical contact with a high contact force are achieved in that the contact spring lamellae are connected to the contact sleeve or to the casing wall of the contact sleeve in an interlocking manner at both axial ends.

A contact area with low levels of mechanical stress during compression of the contact spring lamellae is achieved in that the raised portions are of arcuate form.

Particularly advantageous grading of the plugging force when the contact sleeve is inserted into a mating plug is achieved in that the axial offset length between the raised portions of different or axially adjacent pairs of contact spring lamellae is 0.1 mm to 0.3 mm, in particular 0.2 mm, or a multiple thereof.

A symmetrical arrangement of the contact spring lamellae on the contact sleeve is achieved in that n, where $n \geq 2$, pairs of contact spring lamellae are formed on the contact sleeve, wherein the contact spring lamellae are at a distance from one another in the circumferential direction through an angle of $360°/(2*n)$.

The invention will be explained in more detail below with reference to the drawing, in which FIG. 1 shows a side view of a preferred embodiment of a contact sleeve according to the invention;

Figure 1:
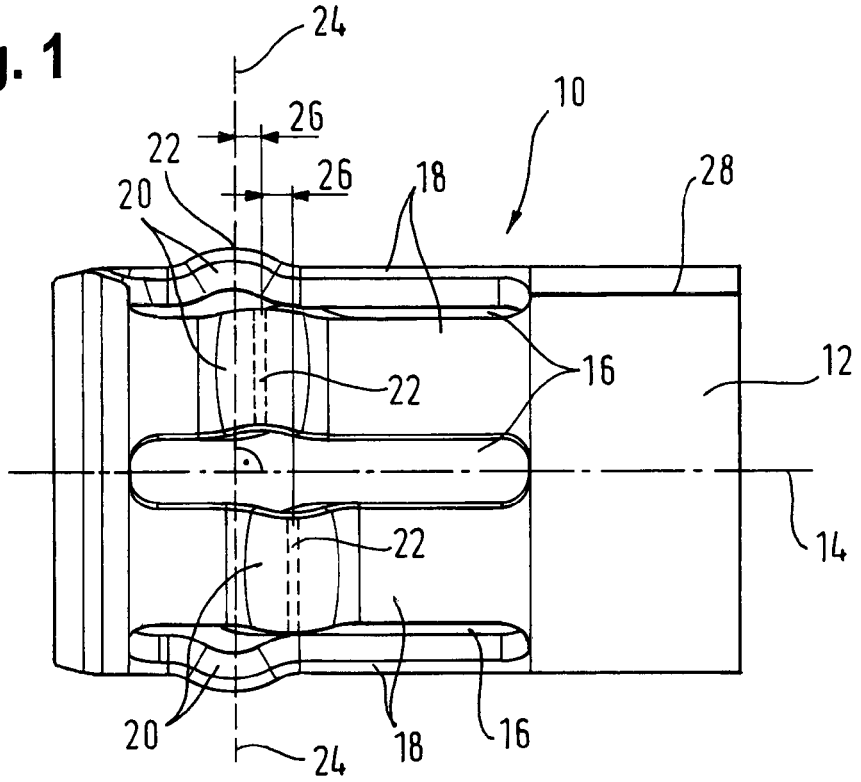
Figure 2:
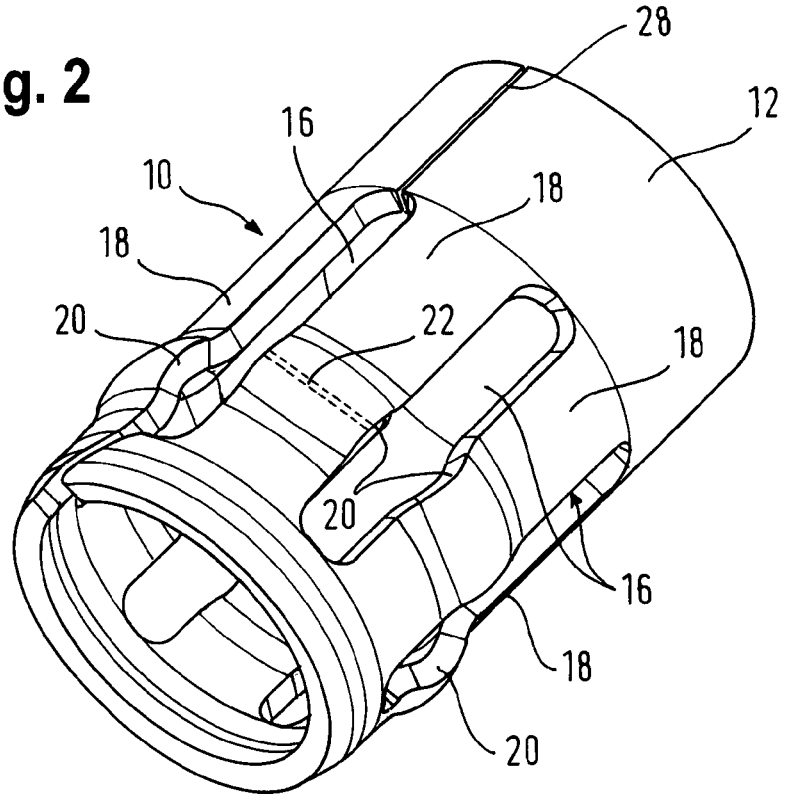
FIG. 2 shows a perspective view of the preferred embodiment of a contact sleeve according to the invention in line with FIG. 1.

The preferred embodiment, illustrated in FIGS. 1 and 2, of a contact sleeve 10 according to the invention is designed in the form of a hollow cylinder having a casing wall 12 and a center longitudinal axis 14. Three pairs of contact spring lamellae 18 are formed by recesses 16 which are at a uniform distance from one another in the circumferential direction, wherein the two contact spring lamellae 18 of a pair are arranged radially opposite one another on the casing wall 12 in each case. Each contact spring lamella 18 extends substantially parallel to the center longitudinal axis 14 in the axial direction. Respective axial ends of each contact spring lamella 18 are formed in an interlocking manner with the casing wall 12 of the contact sleeve 10.

Each contact spring lamella 18 has a radial raised portion 20 which is of arcuate form. In the illustrated exemplary embodiment, the raised portion protrudes radially outward beyond the casing wall 12 of the contact sleeve 10. Each radial raised portion forms a contact area 22 at its highest point (indicated by dashed lines) which is designed to make electrical and mechanical contact with a mating connector. In the illustrated exemplary embodiment, the contact areas 22 are of rectangular form and extend substantially at a right angle to the center longitudinal axis 14. The raised portions of a pair of radially opposite contact spring lamellae 18 are located on a straight line 24 which intersects the center longitudinal axis 14 at a right angle.

According to the invention, the raised portions 20 or contact areas 22 of different pairs of contact spring lamellae 18 are at a distance from one another or offset by a predetermined axial offset length 26 in the axial direction with respect to the contact sleeve 10. In the present example according to FIGS. 1 and 2, three pairs of contact spring lamellae 18 are arranged on the contact sleeve 10 and the respective contact areas 22 are at an axial distance from one another by the axial offset length 26. This axial offset length 26 extends substantially parallel to the center longitudinal axis 14.

In the illustrated exemplary embodiment, the contact sleeve 10 is in the form of a stamped and bent part and accordingly has a joining slot 28. Furthermore, the contact sleeve 10 is produced from an electrically conductive and spring-elastic material, so that the contact spring lamellae 18 can be deflected in an elastically resilient manner. During insertion of the contact sleeve 10, as illustrated in FIGS. 3 to 6, the contact areas 22 of the raised portions 20 make contact with an inner surface 30 (FIG. 3) of a mating connector 32 (FIG. 3) in such a way that the contact spring lamella 18 which accordingly forms part of the raised portions 20 is deflected radially inward in a spring-elastic manner. The resulting return force of the contact spring lamella 18 accordingly generates a contact force with which the contact area 2 is pressed against the inner side 30 of the mating connector 32, so that electrical contact is formed between the contact spring lamella 18 and the inner side 30 of the mating connector 32 with contact force and contact area 22. A corresponding contact pressure is then given by the quotient of contact force to contact area 22.

When the contact sleeve 10 is inserted into the mating connector 32, the contact spring lamellae 18 are therefore deflected radially inward, this leading to a corresponding required plugging force which has to be overcome during insertion of the contact sleeve 10 into the mating connector 32. Since, according to the invention, the raised portions 20 are arranged in a manner axially offset in relation to one another, this required plugging force is reduced.

Figure 3:
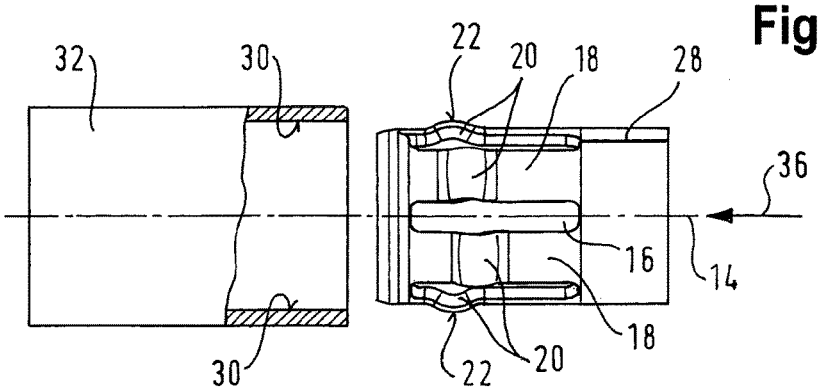
FIG. 3 shows a side view of the preferred embodiment of a contact sleeve according to the invention in line with FIG. 1 before insertion into a mating connector.

The plugging process will be explained below with reference to FIGS. 3 to 6. FIG. 3 shows the contact sleeve 10 according to the invention with a corresponding mating connector 32 immediately before plug-connection. The contact sleeve 10 and the mating connector 32 are oriented in alignment with their respective longitudinal axes and are moved toward one another axially in arrow direction 36 for plugging purposes.

Figure 4:
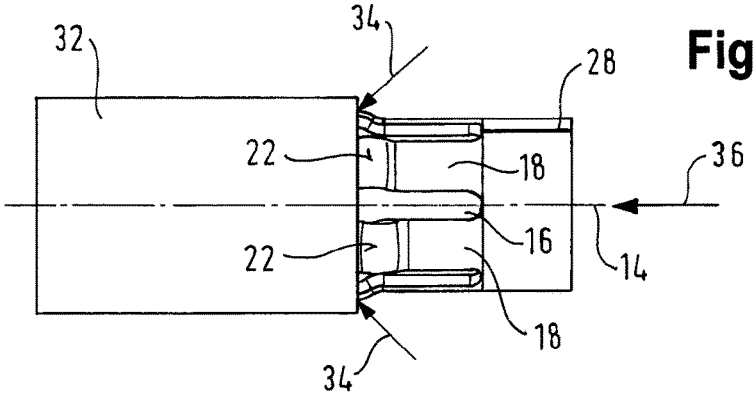
FIG. 4 shows a side view of the preferred embodiment of a contact sleeve according to the invention in line with FIG. 1 in a first partially inserted state during insertion into a mating connector.

FIG. 4 illustrates the first mechanical contact between the contact sleeve 10 and the mating connector 32. In this case, the raised portions 20 of a first pair of contact spring lamellae 18 make contact with the inner surface 30 of the mating connector 32, as identified by arrows 34, wherein the raised portions 20 of the other two pairs of contact spring lamellae 18 are still axially at a distance from the inner surface 30 of the mating connector 32 at the same time, so that they are not yet in mechanical contact with the mating connector 32. Accordingly, it is necessary during insertion for only the contact spring lamellae 18 of the first pair of contact spring lamellae 18 to be deflected radially inward, this accordingly requiring a smaller force than if all of the contact spring lamellae 18 of all of the pairs of contact spring lamellae 18 had to be deflected radially inward at the same time.

Figure 5:
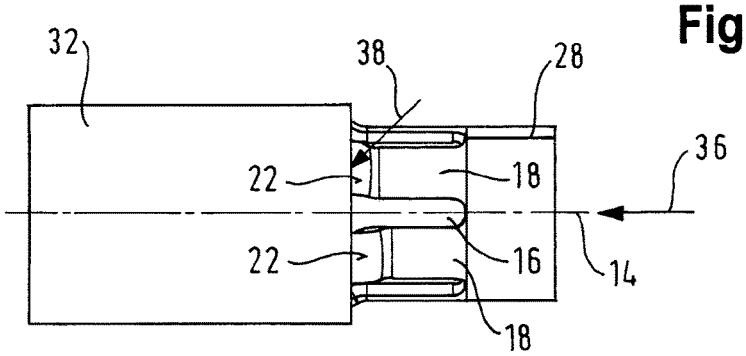
FIG. 5 shows a side view of the preferred embodiment of a contact sleeve according to the invention in line with FIG. 1 in a second partially inserted state during insertion into a mating connector.

In FIG. 5, the contact spring lamellae 18 of the first pair of contact spring lamellae 18 are already deflected completely radially inward and the raised portions 20 of a second pair of contact spring lamellae 18 make mechanical contact with the inner surface 30 of the mating plug connector 32, as identified by arrow 38. Accordingly, during further insertion of the contact sleeve 10 into the mating connector 32, only the contact spring lamellae 18 of the second pair of contact spring lamellae 18 have to be deflected radially inward. At the same time, the raised portions 20 of the remaining third pair of contact spring lamellae 18 are still axially at a distance from the inner surface 30 of the mating connector 32, so that they are not yet in mechanical contact with the mating connector 32. The contact spring lamellae 18 of the first pair of contact spring lamellae 18 only contribute to the plugging force by way of a frictional resistance, so that, overall, the plugging force is also smaller in this stage of the plug-connection operation than if all of the contact spring lamellae 18 of all of the pairs of contact spring lamellae 18 had to be deflected radially inward at the same time.

Figure 6:
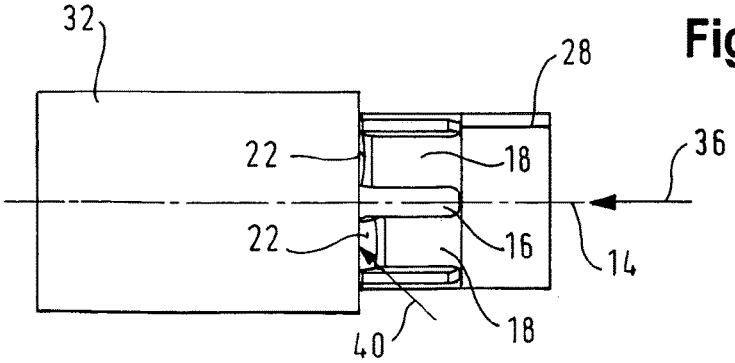
FIG. 6 shows a side view of the preferred embodiment of a contact sleeve according to the invention in line with FIG. 1 in a fully inserted state during insertion into a mating connector.

In FIG. 6, the contact spring lamellae 18 of the second pair of contact spring lamellae 18 are now also already deflected completely radially inward and the raised portions 20 of the third pair of contact spring lamellae 18 now make mechanical contact with the inner surface 30 of the mating plug connector 32, as identified by arrow 40. The contact spring lamellae 18 of the second pair of contact spring lamellae 18, like the contact spring lamellae 18 of the first pair of contact spring lamellae 18, now contribute to the plugging force only by way of a frictional resistance. In this stage of the plug-connection operation, only the contact spring lamellae 18 of the third pair of contact spring lamellae 18 accordingly have to be deflected radially inward. Furthermore, overall, the plugging force in this stage of the plug-connection operation is also smaller than if all of the contact spring lamellae 18 of all of the pairs of contact spring lamellae 18 had to be deflected radially inward at the same time.

Therefore, as a result, owing to the axially offset arrangement of the raised portions 20 of the pairs of contact spring lamellae 18 over the entire axial plugging path, a reduced plugging force is produced in comparison to a plug-in process in which all of the contact spring lamellae 18 of all of the pairs of contact spring lamellae 18 have to be deflected radially inward at the same time.

The predetermined axial offset length 26 is, for example, 0.1 mm to 0.3 mm. In the illustrated exemplary embodiment, the axial offset length 26 has a value of 0.2 mm.

The invention claimed is:

1. A connector, comprising:

a first terminal connector comprising a first substantially cylindrical outer conductor and a first inner conductor concentric to said first outer conductor; and a second terminal connector comprising a second substantially cylindrical outer conductor and a second inner conductor concentric to said second outer conductor, wherein in an engaged state of said first terminal connector and said second terminal connector, an outer surface of said first outer conductor contacts an inner surface of said second outer conductor to establish a first high-frequency signal path, and said first inner conductor contacts said second inner conductor to establish a second high-frequency signal path, said first outer conductor comprises a plurality of openings that define at least two pairs of beams, each pair of beams comprising a first beam and a second beam diametrically opposite said first beam, said first beam comprising a first bump in a radially outward direction and said second beam comprising a second bump in a radially outward direction such that an apex of said first bump and an apex of said second bump are located on a plane perpendicular to a central longitudinal axis of said first outer conductor, and said plane of a first pair of said pairs of beams is offset from said plane of a second pair of said pairs of beams in an axial direction.

2. The connector of claim 1, wherein:

each beam of said pairs of beams extends in an axial direction, each axial end of each beam being connected to a respective other portion of said first outer conductor.

3. The connector of claim 1, wherein:

in a non-engaged state of said first terminal connector and said second terminal connector, said first outer conductor comprises an open slit between a first edge of said first outer conductor and a second edge of said first outer conductor, said open slit extending an entire length of said first outer conductor in an axial direction.

4. The connector of claim 1, wherein:

a minimum diameter of said first outer conductor in said engaged state is essentially identical to a minimum diameter of said first outer conductor in a non-engaged state of said first terminal connector and said second terminal connector.

5. The connector of claim 1, wherein:

said plane of a third pair of said pairs of beams is offset from said plane of said second pair and from said plane of said first pair in an axial direction.

6. The connector of claim 1, comprising:

at least one of an insulator and a dielectric situated between said first outer conductor and said first inner conductor.

7. The connector of claim 1, wherein:

for each of said pairs of beams, said apex of said first bump and said apex of said second bump are situated in an axial half of said first terminal connector that first engages said second terminal connector as said coaxial connector transitions from a non-engaged state of said first terminal connector and said second terminal connector to said engaged state.

* * * * *